United States Patent [19]

Emerson

[11] Patent Number: 4,792,278

[45] Date of Patent: Dec. 20, 1988

[54] TURBOCOOLER WITH MULTISTAGE TURBINE WHEEL

[75] Inventor: Terence P. Emerson, Hermosa Beach, Calif.

[73] Assignee: Allied-Signal, Inc., Los Angeles, Calif.

[21] Appl. No.: 85,904

[22] Filed: Aug. 14, 1987

[51] Int. Cl.[4] ..... F04D 29/58

[52] U.S. Cl. ..... 415/178; 415/143; 415/DIG. 7

[58] Field of Search ..... 415/175, 176, 177, 178, 415/83, 52, 56, 58, 143, 187, DIG. 7

[56] References Cited

U.S. PATENT DOCUMENTS

| | | | |
|---|---|---|---|
| 2,020,793 | 11/1935 | Meininghaus | 415/84 |
| 2,099,699 | 11/1937 | Meininghaus | 415/84 |
| 2,625,012 | 1/1953 | Larrecq | 60/39.161 |
| 2,904,307 | 9/1959 | Balje et al. | 415/85 |
| 2,933,884 | 4/1960 | Foster | 60/595 |
| 3,116,908 | 1/1964 | Wosika | 415/143 |
| 3,143,103 | 8/1964 | Zuhn | 60/599 |
| 3,250,221 | 5/1966 | Williams | 415/176 |
| 3,435,771 | 4/1969 | Riple | 415/123 |
| 3,961,866 | 6/1976 | Nichols | 415/DIG. 7 |
| 4,141,672 | 2/1979 | Wieland et al. | 415/202 |
| 4,155,684 | 5/1979 | Curiel et al. | 415/199.2 |
| 4,458,493 | 7/1984 | Amir et al. | 415/199.6 |
| 4,548,545 | 10/1985 | Lewis et al. | 415/DIG. 7 |

*Primary Examiner*—Robert E. Garrett
*Assistant Examiner*—John T. Kwon
*Attorney, Agent, or Firm*—J. H. Muetterties; J. W. McFarland; D. B. Abel

[57] ABSTRACT

A turbocooler includes a multistage turbine wheel for simultaneous and independent interaction with multiple gas streams to reduce the temperature levels of the gas streams. The turbine wheel includes at least two turbine stages designed to discharge the respective gas streams at different temperature levels, wherein the warmer gas stream is interposed between the colder gas stream and a turbocooler load. The warmer gas stream thus provides a thermal barrier isolating the colder gas stream from turbocooler heat sources thereby permitting increased temperature reduction of the colder gas stream for use, for example, in cryocooler applications. The multistage turbine wheel further facilitates bearing lift-off, for example, in a foil bearing machine.

13 Claims, 4 Drawing Sheets

TURBOCOOLER WITH MULTISTAGE TURBINE WHEEL

The invention was made with Government support under Contract No. F29601-85-C-0108, awarded by the Department of the Air Force. The Government has certain rights in this invention.

BACKGROUND OF THE INVENTION

This invention relates generally to turbine cooling systems including one or more rotatably driven turbines for extracting energy from and concurrently reducing the temperature of a gas stream. More particularly, this invention relates to an improved and simplified multiple stage turbine system designed for simultaneous interaction with more than one gas stream.

Turbine cooling systems or turbocoolers in general are relatively well known in the art. Such systems commonly comprise a turbine wheel mounted within an appropriately shaped turbine housing and having a set of vanes positioned along a gas flow path defined by the housing. A relatively high energy gas stream flowing along the gas flow path passes into driving engagement with the turbine vanes to rotatably drive the turbine wheel typically at a relatively high rotational speed. The turbine wheel is normally coupled to and thus rotatably drives a selected load such as an alternator for producing electrical power, or a fan, etc. Accordingly, the driving interaction between the gas stream and the turbine wheel drives the selected load thereby extracting work from the gas stream. At the same time, the gas stream is volumetrically expanded by the turbine wheel to result in a significant reduction in gas stream temperature.

Turbocoolers of the above-identified type are used in many aircraft and spacecraft and other applications wherein a circulating gas stream is utilized to maintain system components at a desired operating temperature. The turbine wheel is designed to reduce the temperature of the gas stream to a specified output temperature, whereupon the cool gas is circulated into heat transfer relation with system heat sources to control the temperature thereof followed by recirculation of the heated gas into driving relation with the turbine wheel. In this manner, the turbocooler provides an effective apparatus for controlling the operating temperature of a wide range of system components such as electrical or electronic components, aircraft or spacecraft cabin space, etc., while beneficially converting at least some of the extracted heat energy to a useful form.

In some specialized cooling applications, multiple heat loads in a system require cooling gas streams at different temperatures and/or different flow rates for proper temperature maintenance. In such applications, multiple turbocoolers can be used to provide the required gas streams for cooling purposes, but the use of multiple turbocoolers undesirably increases the overall complexity and cost of the system while correspondingly decreasing overall system reliability. Alternately, multiple stage turbocoolers have been proposed with multiple turbine wheels mounted on a common shaft adapted for individual interaction with separate gas streams. While this multistage approach advantageously reduces the complexity of the overall multistream cooling system, in comparison with the use of separate turbocoolers, an increased overall shaft length is required resulting in an increased likelihood of encountering destructive critical speeds. Moreover, undesired mixing of the separate gas streams can result. Still further, when cooling gas is required at substantially cryogenic temperatures, previous turbocooler designs have not provided an effective way to isolate the cryogenic gas from heat sources within the turbocooler itself, resulting in limited turbocooler efficiency. Such turbocooler heat sources may include, for example, bearing heat, or heat produced by the driven load such as an alternator or the like.

There exists, therefore, a need for improvements in turbocoolers particularly with respect to providing a simplified turbocooler construction of compact overall size yet including the capability to produce multiple gas streams at different temperatures for cooling purposes. Moreover, there exists a need for an improved turbocooler designed to provide a cryogenic gas stream at a temperature which is substantially independent of internal turbocooler heat sources. The present invention fulfills these needs and provides further related advantages.

SUMMARY OF THE INVENTION

In accordance with the invention, an improved turbocooler is provided with a unitary turbine wheel having multiple operating stages for interacting separately with multiple gas streams. The turbine wheel stages are designed to produce gas outflow streams at different temperatures, with the colder gas stream being discharged at a cryogenic temperature, if desired. The turbine wheel stages are arranged with a warmer stream interposed between the colder stream and a load driven by the turbocooler, thereby isolating the colder stream from heat sources associated with the driven load.

In one form of the invention, the multistage turbine wheel is mounted for rotation with a driven shaft connected to an output load, such as an alternator or the like. The turbine wheel includes a first turbine stage separated from the driven load by a housing backplate. A first gas stream is circulated into driving relation with the first turbine stage and is then discharged therefrom via appropriate inflow and outflow conduit members. A second turbine stage also formed directly on the turbine wheel is positioned at one side of the first turbine stage opposite the housing backplate, and in a position for driving interaction with a second gas stream circulated through appropriate inflow and outflow conduits. The second turbine stage is designed to produce the second gas stream at an outflow temperature substantially less than the first turbine stage. Accordingly, the single turbine wheel is driven simultaneously by both gas streams, with the warmer first stream serving as a thermal barrier isolating the colder second stream from the driven load and related heat sources therein.

Other features and advantages of the present invention will become more apparent from the following detailed description, taken in conjunction with accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
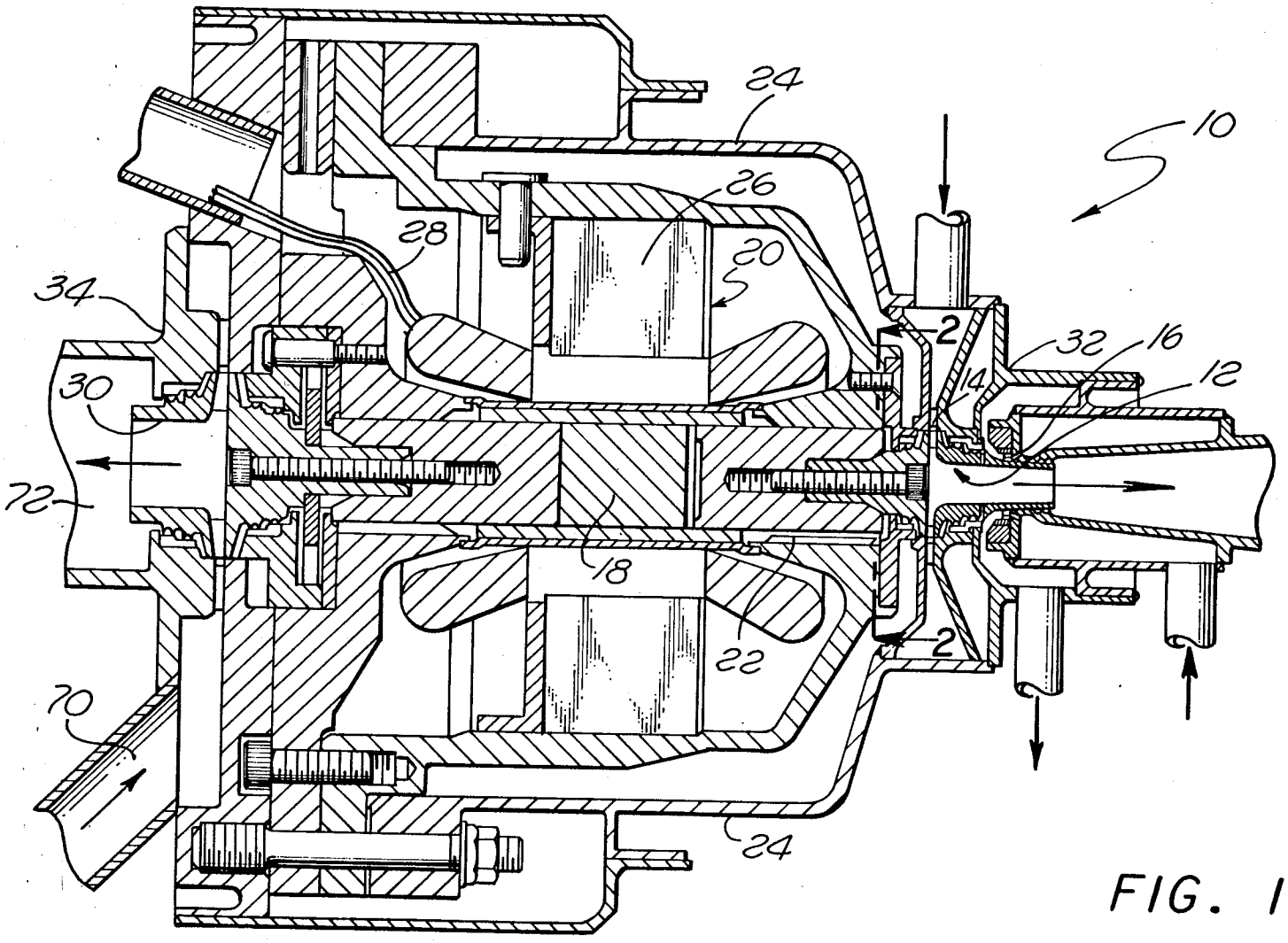
FIG. 1 is a fragmented sectional view depicting an improved turbocooler with a multiple stage turbine wheel embodying the novel features of the invention.

As shown in the exemplary drawings, a turbocooler referred by generally in FIG. 1 by the reference numeral 10 is provided with a multistage turbine wheel 12. The multistage turbine wheel 12 includes, in a single turbine wheel structure, a first turbine stage 14 and a second turbine stage 16 adapted to be driven by different gas streams to rotate an output shaft 18 coupled to a turbocooler load, such as an alternator 20 as depicted in FIG. 1.

The turbocooler 10 of the present invention provides a compact apparatus designed for efficient extraction of energy from multiple gas streams, thereby reducing the temperature levels of the gas streams and obtaining useful work therefrom. The invention is particularly designed for providing circulating cooling gas flows to system or components such as electrical or electronic equipment in an aerospace environment, wherein such systems or components generate heat during operation or are otherwise subject to undesirable temperature rises unless cooled. The improved turbocooler is provided as part of a cooling system and includes turbine components driven by the circulating gas streams to expand the gases and thereby reduce the temperature levels of the gases. Heat energy extracted from the gases is used to drive a turbocooler load shown in the form of an alternator 20 for producing useful electrical power, although other types of turbocooler loads such as fans or the like can be used.

Figure 2:
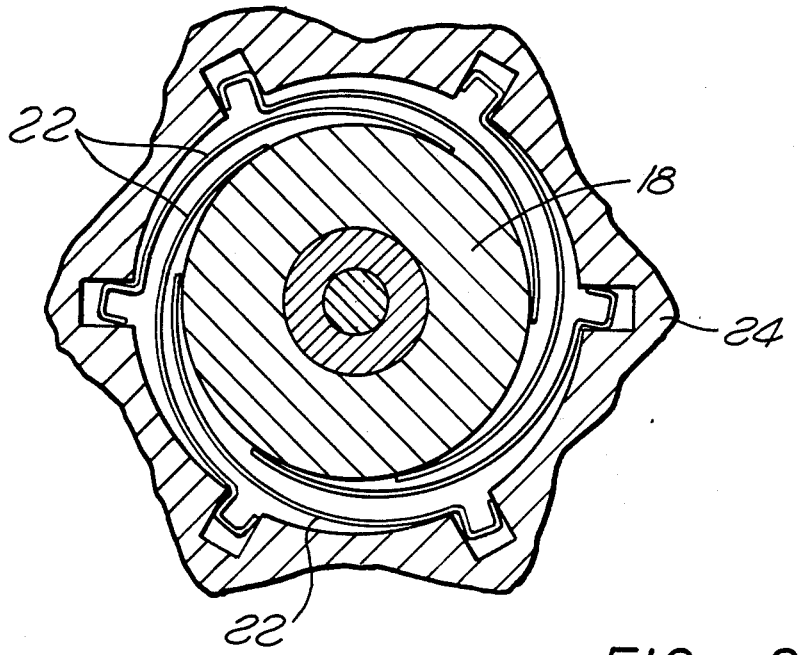
FIG. 2 is a vertical sectional view taken generally on the line 2—2 of FIG. 1.
Figure 4:
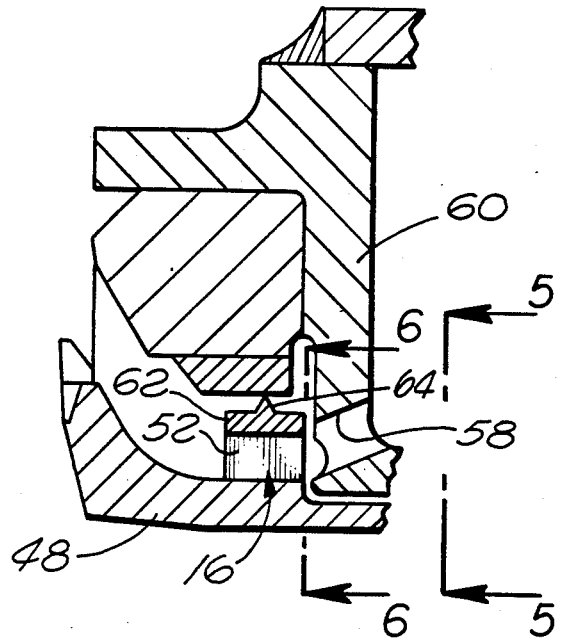
FIG. 4 is an enlarged fragmented sectional view corresponding with the encircled region 4 of FIG. 3.
Figure 3:
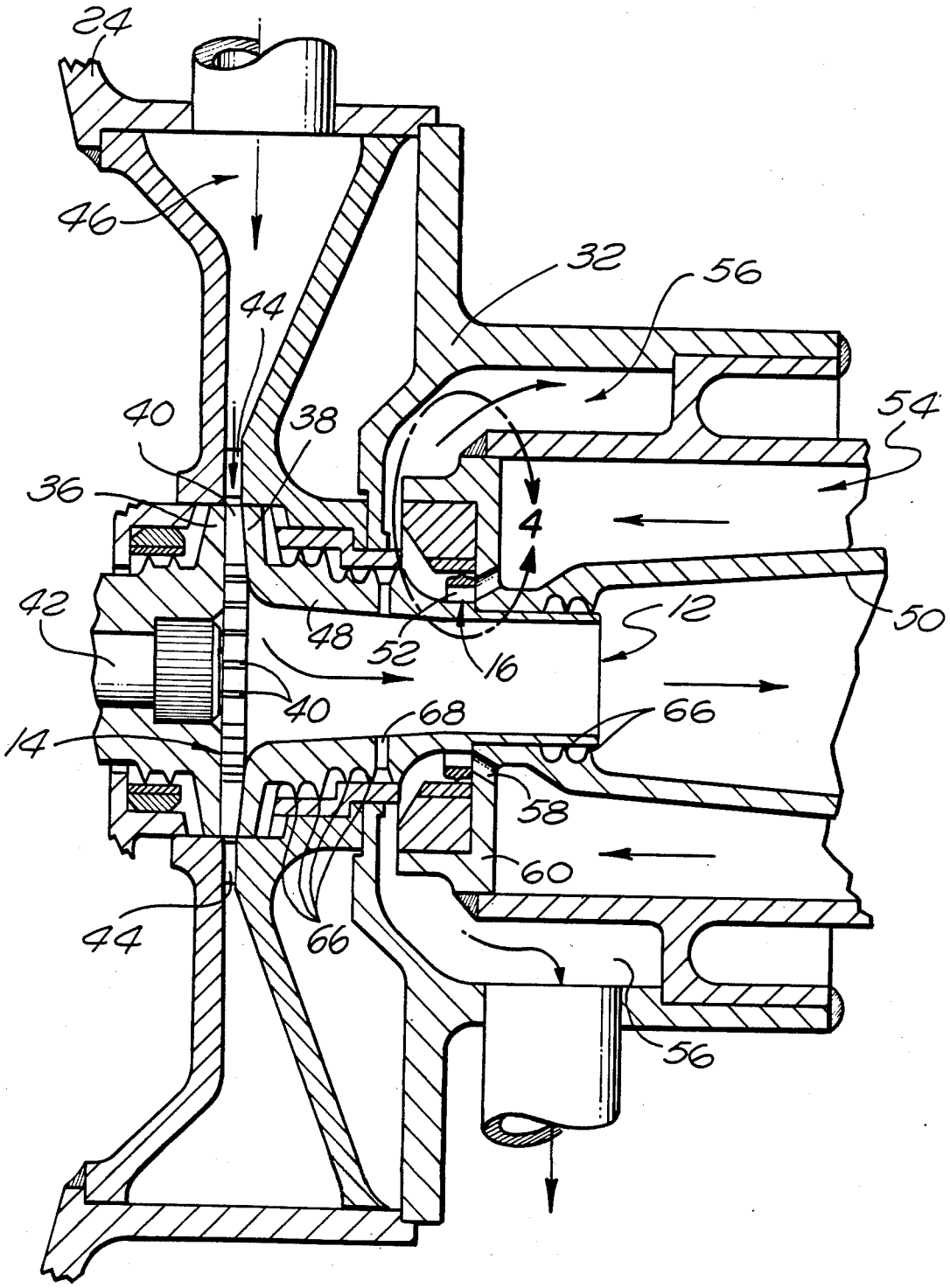
FIG. 3 is an enlarged fragmented sectional view corresponding with a portion of FIG. 1.
Figure 5:
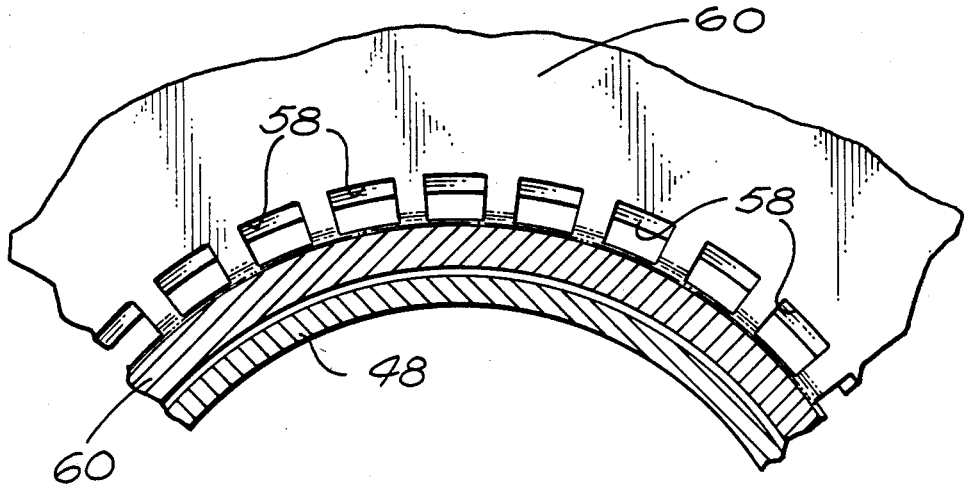
FIG. 5 is an enlarged fragmented vertical sectional view taken generally on the line 5—5 of FIG. 4.
Figure 6:
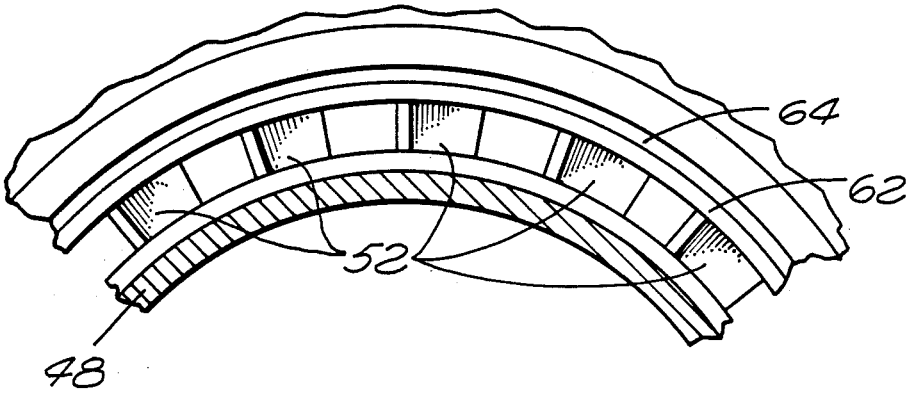
FIG. 6 is an enlarged fragmented vertical sectional view taken generally on the line 6—6 of FIG. 4.

In general terms, in accordance with primary aspects of the invention, the improved turbocooler 10 uses the single turbine wheel 12 with the multiple turbine stages 14 and 16 for driving interaction with a corresponding pair of circulating cooling gas streams. With this arrangement, the construction of the overall turbocooler is significantly simplified by reduction in the number of turbine wheels, shafts, and related bearings normally required in compound stage turbocoolers. The improved turbocooler is adapted for use in relatively low power aerospace applications and the like, with the multistage turbine wheel 12 extracting energy from the two gas streams to insure adequate lift-off torque particularly when output shaft bearings 22 (FIG. 2) of the foil bearing type are used. Moreover, the two turbine stages 14 and 16 will typically be designed to discharge their respective gas streams at different temperature levels, with the colder gas stream being beneficially separated from the turbocooler load 20 and the heat sources inherent therein by the intervening warmer gas stream. As a result, the overall operation of the turbocooler is rendered more efficient particularly when the colder gas stream is desired at a low, cryocooler temperature level.

As shown generally in FIG. 1, the illustrative turbocooler 10 includes the multistage turbine wheel 12 mounted at one end of the output shaft 18 which is supported for rotation within a central housing 24 by the foil bearings 22 or the like. The output shaft 18 carries a permanent magnet for the alternator 20 in proximity with windings 26 mounted within the central housing 24. Appropriate conductors 28 extend from the alternator 20 to couple generated electrical power to other system components (not shown). An auxiliary turbine wheel 30 is commonly mounted at the end of the output shaft 18 opposite the multistage turbine wheel 12 for driving association with still another gas stream, as will be described.

The multistage turbine wheel 12 includes the two turbine stages 14 and 16 for driving interaction with separate gas streams. In this regard, the multistage turbine wheel 12 is mounted within a multistage housing 32 at one end of the central turbocooler housing 24, wherein the multistage housing 32 defines flow conduits and chambers for separate gas stream inflow and outflow relative to the two turbine stages 14 and 16. Similarly, an auxiliary turbine housing 34 is mounted at the opposite end of the turbocooler to define flow conduits and chambers guiding another gas stream for inflow and outflow relative to the auxiliary turbine wheel 30.

The multistage turbine wheel 12 is shown best in FIGS. 3-6. More particularly, with reference to FIG. 3, one preferred turbine wheel construction comprises a turbine wheel backplate 36 and annular forward shroud 38 having an annular array of radial flow vanes 40 supported therebetween. The backplate is appropriately secured by a bolt 42 or the like to the output shaft 18 in a manner positioning the vanes 40 in axial alignment with a radial flow nozzle 44 for guiding a first gas stream from an annular plenum chamber 46 into driving relation with the vanes 40. Accordingly, the vanes 40 define the first turbine stage 14 of the multistage turbine wheel 12 for correspondingly driving the output shaft 18. The first gas stream is thus expanded by the first turbine stage 14 for axial discharge through a hollow axial hub 48 into a discharge conduit 50 and subsequent recirculation to targeted heat loads before return flow into driving relation with the vanes 40.

The second turbine stage 16 is shown in detail in FIGS. 3-6 and comprises an annular array of short turbine vanes 52 formed about the exterior of the hollow axial hub 48 of the multistage turbine wheel 12. These vanes 52 comprise axial flow turbine vanes set between an annular plenum chamber 54 and an annular discharge chamber 56 associated with the second gas stream. Flow nozzles 58 in a housing wall 60 permit flow of the second gas stream into driving relation with the vanes 52 to rotatably drive the turbine wheel 12 in the same rotational direction as the first gas stream interacting with the radial flow vanes 40. A circumferential blade shroud 62 with associated lip seal 64 are provided to prevent the gas stream from bypassing the vanes 52 upon flow into the discharge chamber 56 for subsequent recirculation to the associated heat load or loads.

While the specific gases used in the first and second gas streams will frequently be the same, such as helium or other suitable cooling gas, the two turbine stages 14 and 16 will normally produce gas outflows at different temperature levels as required by their respective heat loads. Accordingly, the turbine wheel 12 conveniently includes relatively simple seal means to prevent significant intermixing of the two gas streams as they flow into driving association with the wheel 12. The illustrative seal means includes sets of labyrinth seals 66 on the exterior of the hollow hub 48 at positions on axially opposite sides of the second stage vanes 52. With this arrangement, significant leakage of either gas, prior to expansion, along the exterior of the wheel is prevented. Bypass ports 68 in the hub 48 may also be provided to circulate any leakage of the first gas stream into the associated outflow without mixing with the second stream.

In accordance with one aspect of the invention, the first gas stream and its related flow chambers and passages associated with the first turbine stage 14 are physically positioned axially between the turbocooler load inclusive of the alternator 20 and bearing 22, and the second gas stream associated with the second turbine stage 16. With this arrangement, the second stage 16 can be designed to produce a low temperature gas outflow at cryocooler temperature levels, if required, whereas the first stage 14 can be designed to produce a somewhat warmer gas outflow. The juxtaposition of the first gas stream between the load and the second gas stream presents an effective thermal barrier isolating the colder stream from heat sources inherent in the load, such as bearing heat, windage losses, alternator heat, etc. The resultant overall efficiency of the turbocooler particularly with respect to the colder gas stream in thus enhanced.

The auxiliary turbine wheel 30 (FIG. 1) may be provided in any convenient form, or, in the alternative, omitted in its entirety. However, for completeness of description, the illustrative auxiliary turbine wheel 30 also comprises a radial inflow turbine stage rotatably driven by a third gas stream flowing through inflow and outflow conduits 70 and 72, respectively. The provision of the auxiliary turbine wheel 30 permits the turbocooler 10 to operate simultaneously with three different gas streams to produce three different temperature gas outflows for cooling purposes, while using only two turbine wheels, a single output shaft, and a single set of shaft bearings. Alternately, the auxiliary wheel 30 may be substituted for another multistage turbine wheel such as the wheel 12, thereby providing multistage operation at both ends of the shaft.

A variety of modifications and improvements to the improved turbocooler 10 will be apparent to those skilled in the art. Accordingly, no limitation is intended by way of the description herein or the accompanying drawings, except by way of the appended claims.

What is claimed is:

1. A turbocooler, comprising:

a multistage turbine wheel having at least first and second sets of turbine vanes formed hereon;

an output shaft rotatable with said turbine wheel;

a load driven by said output shaft;

means for supplying a first gas stream into driving interaction with said first set of vanes to rotatably drive said turbine wheel and to reduce the temperature of said first gas stream; and means for supplying a second gas stream into driving relation with said turbine wheel and to reduce the temperature of said second gas stream, said multistage turbine wheel comprising an elongated hollow and generally cylindrical hub, a set of radial flow vanes formed generally at one end of said hub to define said first set of vanes, and a set of axial flow vanes formed about the exterior of said hub in axially spaced relation to said radial flow vanes, said axial flow vanes defining said second set of vanes.

2. The turbocooler of claim 1 wherein said first and second gas streams interact with said turbine wheel to drive turbine wheel in the same rotational direction.

3. The turbocooler of claim 1 wherein said means for supplying said first and second gas streams supplies said gas streams for simultaneously driving said turbine wheel.

4. The turbocooler of claim 1 further including foil bearing means for rotatably supporting said output shaft.

5. The turbocooler of claim 1 wherein said second set of vanes reduces the temperature of said second gas stream to a temperature level colder than the temperature to which the first gas stream is reduced by said first set of vanes, said means for supplying said first gas stream being generally axially interposed between said load and said means for supplying said second gas stream.

6. The turbocooler of claim 1 further including seal means on said hub axially between said radial flow vanes and said axial flow vanes.

7. The turbocooler of claim 1 wherein said means for supplying said first gas stream comprises housing means defining an annular chamber for supplying said first gas stream to said radial flow vanes and for further defining an axial flow conduit for discharge of said first gas stream from said hub, said means for supplying said second gas stream comprising housing means defining an annular chamber for supplying said second gas stream to said axial flow vanes and further defining an annular discharge chamber for discharge of said second gas stream from said axial flow vanes.

8. The turbocooler of claim 1 wherein said axial flow vanes include a circumferential tip shroud.

9. The turbocooler of claim 1 wherein said load comprises an alternator.

10. A turbocooler, comprising:

a multistage turbine wheel having first and second sets of vanes formed thereon;

a turbine housing; and means for rotatably supporting said turbine wheel within said turbine housing;

said housing including means for independently and simultaneously circulating first and second gas streams respectively into driving relation with said first and second sets of vanes for rotatably driving said turbine wheel in the same rotational direction and for expanding said first and second gas streams to reduce the temperature levels thereof, said multistage turbine wheel comprising an elongated hollow and generally cylindrical hub, a set of radial flow vanes formed generally at one end of said hub to define said first set of vanes, and a set of axial flow vanes formed about the exterior of said hub in axially spaced relation to said radial flow vanes, said axial flow vanes defining said second set of vanes.

11. The turbocooler of claim 10 further including a load driven by said turbine wheel.

12. The turbocooler of claim 11 wherein said second set of vanes reduces the temperature of said second gas stream to a temperature level colder than the temperature to which the first gas stream is reduced by said first set of vanes, said first set of vanes being interposed axially between said second set of vanes and said load.

13. The turbocooler of claim 10 wherein said rotatable support means comprises an output shaft, and foil bearing means for rotatably supporting said output shaft.

* * * * *